US010538300B2

(12) United States Patent
Haynes et al.

(10) Patent No.: US 10,538,300 B2
(45) Date of Patent: Jan. 21, 2020

(54) LIFE RAFT CANOPY FOR STABILIZING BALLAST CAVITY

(71) Applicant: GOODRICH CORPORATION, Charlotte, NC (US)

(72) Inventors: Timothy C. Haynes, Prescott Valley, AZ (US); Daniel Bahena, Phoenix, AZ (US)

(73) Assignee: GOODRICH CORPORATION, Charlotte, NC (US)

( * ) Notice: Subject to any disclaimer, the term of this patent is extended or adjusted under 35 U.S.C. 154(b) by 28 days.

(21) Appl. No.: 15/681,198

(22) Filed: Aug. 18, 2017

(65) Prior Publication Data

US 2019/0054987 A1 Feb. 21, 2019

(51) Int. Cl.

*B63B 35/58* (2006.01)
*B63C 9/04* (2006.01)
*B63B 43/06* (2006.01)

(52) U.S. Cl.

CPC ..... *B63C 9/04* (2013.01); *B63B 43/06* (2013.01); *B63C 2009/042* (2013.01); *B63C 2009/046* (2013.01)

(58) Field of Classification Search

CPC . B63C 9/04; B63C 2009/04; B63C 2009/042; B63C 2009/044; B63C 2009/046; B63B 43/06; B63B 2043/042

USPC ..... 441/35, 37, 38, 40, 42, 44

See application file for complete search history.

(56) References Cited

U.S. PATENT DOCUMENTS 3,736,607 A * 6/1973 Radnofsky ..... B63B 7/08 114/122
3,833,088 A 9/1974 Chacko et al.
4,001,905 A * 1/1977 Givens ..... B63C 9/06 114/125
4,216,559 A * 8/1980 Switlik, Jr. ..... B63B 39/02 441/40
4,223,415 A 9/1980 Patton
4,533,333 A * 8/1985 Andrew ..... B63C 9/01 441/38
RE32,560 E * 12/1987 Givens ..... B63C 9/06 114/125
4,750,447 A * 6/1988 Spinosa ..... B63C 9/06 114/345
4,790,784 A * 12/1988 Givens ..... B63B 13/00 114/345
4,890,569 A * 1/1990 Givens ..... B63B 13/00 114/125
5,468,167 A * 11/1995 Givens ..... B63C 9/04 114/125

(Continued)

*Primary Examiner* — Daniel V Venne
(74) *Attorney, Agent, or Firm* — Snell & Wilmer L.L.P.

(57) ABSTRACT

A life raft may include a base having a first side and a second side. The life raft may also include a first canopy coupled to the first side of the base and configured to extend across the first side of the base to form a first chamber defined between the first side of the base and the first canopy. The life raft may further include a second canopy coupled to the second side of the base and configured to extend across the second side of the base to form a second chamber defined between the second side of the base and the second canopy. At least one of the first canopy and the second canopy may define a first plurality of fill ports. The at least one of the first canopy and the second canopy is a bottom canopy configured to extend below the life raft.

7 Claims, 5 Drawing Sheets

(56) References Cited

U.S. PATENT DOCUMENTS

| | | | |
|---|---|---|---|
| 5,733,158 | A | 3/1998 | Higginbotham et al. |
| 6,325,688 | B1 | 12/2001 | Martin |
| 6,367,404 | B1 | 4/2002 | Callahan |
| 6,375,529 | B1 | 4/2002 | Infante et al. |
| 6,623,322 | B1 | 9/2003 | Lesniak |
| 8,382,541 | B1 | 2/2013 | Campbell |
| 2017/0029080 | A1 | 2/2017 | Udupi et al. |

* cited by examiner

LIFE RAFT CANOPY FOR STABILIZING BALLAST CAVITY

FIELD

The present disclosure relates to aircraft evacuation assemblies, and more specifically to life rafts having a canopy that forms a stabilizing ballast cavity.

BACKGROUND

In the event of an emergency water landing, aircraft typically have one or more life rafts that can be deployed to hold evacuated passengers. To protect passengers from the sun, rain, weather conditions, and other elements, life rafts include a canopy for shielding the passengers from the aforementioned conditions. Conventional life rafts often include a plurality of ballast bags that are tethered to the life raft to provide stabilizing ballast support to the life raft, thereby reducing the likelihood of capsizing. Conventional ballast bags, however, may add complexity to the life raft and increase material and manufacturing costs of the life raft.

SUMMARY

According to various embodiments, the present disclosure provides a life raft that includes a base having a first side and a second side. The life raft also includes a first canopy coupled to the first side of the base and configured to extend across the first side of the base to form a first chamber defined between the first side of the base and the first canopy, according to various embodiments. The life raft also includes a second canopy coupled to the second side of the base and configured to extend across the second side of the base to form a second chamber defined between the second side of the base and the second canopy, according to various embodiments. At least one of the first canopy and the second canopy defines a first plurality of fill ports, according to various embodiments.

In various embodiments, the at least one of the first canopy and the second canopy is a bottom canopy configured to extend below the life raft (wherein the terms "bottom" and "below" refer to positions relative to the life raft in use as a flotation device in water). In various embodiments, a corresponding one of the first chamber and the second chamber is configured to be filled with water via the first plurality of fill ports such that the corresponding one of the first chamber and the second chamber functions as a stabilizing ballast cavity.

In various embodiments, the first canopy defines the first plurality of fill ports and the second canopy defines a second plurality of fill ports. In various embodiments, the life raft is reversible. Accordingly, in response to the first chamber being deployed above the base and the second chamber being deployed below the base, the first chamber functions as a passenger compartment and the second chamber functions as a stabilizing ballast cavity. Additionally, in response to the first chamber being deployed below the base and the second chamber being deployed above the base, the first chamber functions as the stabilizing ballast cavity and the second chamber functions as the passenger compartment.

In various embodiments, the first plurality of fill ports includes a first row of fill ports that are distributed circumferentially around the first canopy and the second plurality of fill ports includes a second row of fill ports that are distributed circumferentially around the second canopy. The first canopy may further define a third row of fill ports that are distributed circumferentially around the first canopy and the second canopy may further define a fourth row of fill ports that are distributed circumferentially around the second canopy.

In various embodiments, each fill port of the first plurality of fill ports and the second plurality of fill ports has a cross-sectional area between about 5 $in^2$ (32 $cm^2$) and about 35 $in^2$ (225 $cm^2$). In various embodiments, each fill port of the first plurality of fill ports and the second plurality of fill ports has a cross-sectional area between about 7 $in^2$ (45 $cm^2$) and about 28 $in^2$ (180 $cm^2$). In various embodiments, each fill port comprises a circular aperture having a diameter between about 3 inches (7.6 cm) and about 6 inches (15.2 cm).

In various embodiments, fill ports of the passenger compartment are configured to be closed in response to deployment of the life raft and fill ports of the stabilizing ballast cavity are configured to be open in response to deployment of the life raft. For example, the fill ports of the passenger compartment may include flaps that hang down to cover the fill ports of the passenger compartment and the fill ports of the stabilizing ballast cavity may include flaps that hang down away from the fill ports of the stabilizing ballast cavity.

In various embodiments, the stabilizing ballast cavity is the exclusive ballast component of the life raft. The base may include a first border tube circumscribing the first side of the base and a second border tube circumscribing the second side of the base. The life raft may also include a first arch structure extending from the first side of the base and a second arch structure extending from the second side of the base, wherein the first canopy is coupled to the first arch structure and the second canopy is coupled to the second arch structure.

Also disclosed herein, according to various embodiments, is a method of using a life raft. The method may include inflating the life raft, deploying the life raft in water, and filling the stabilizing ballast cavity with water via the plurality of fill ports. In various embodiments, a first chamber defined between a first canopy and a first side of a base of the life raft is disposed above the water to function as a passenger compartment and a second chamber defined between a second canopy and a second side of the base of the life raft is disposed below the water (e.g., below the surface of the water) to function as a stabilizing ballast cavity, wherein the second canopy defines a plurality of fill ports.

In various embodiments, the method further includes at least partially opening the passenger compartment for passengers to embark. In various embodiments, in response to deploying the life raft in water, the plurality of fill ports are in an open position.

The forgoing features and elements may be combined in various combinations without exclusivity, unless expressly indicated herein otherwise. These features and elements as well as the operation of the disclosed embodiments will become more apparent in light of the following description and accompanying drawings.

Figure 1:
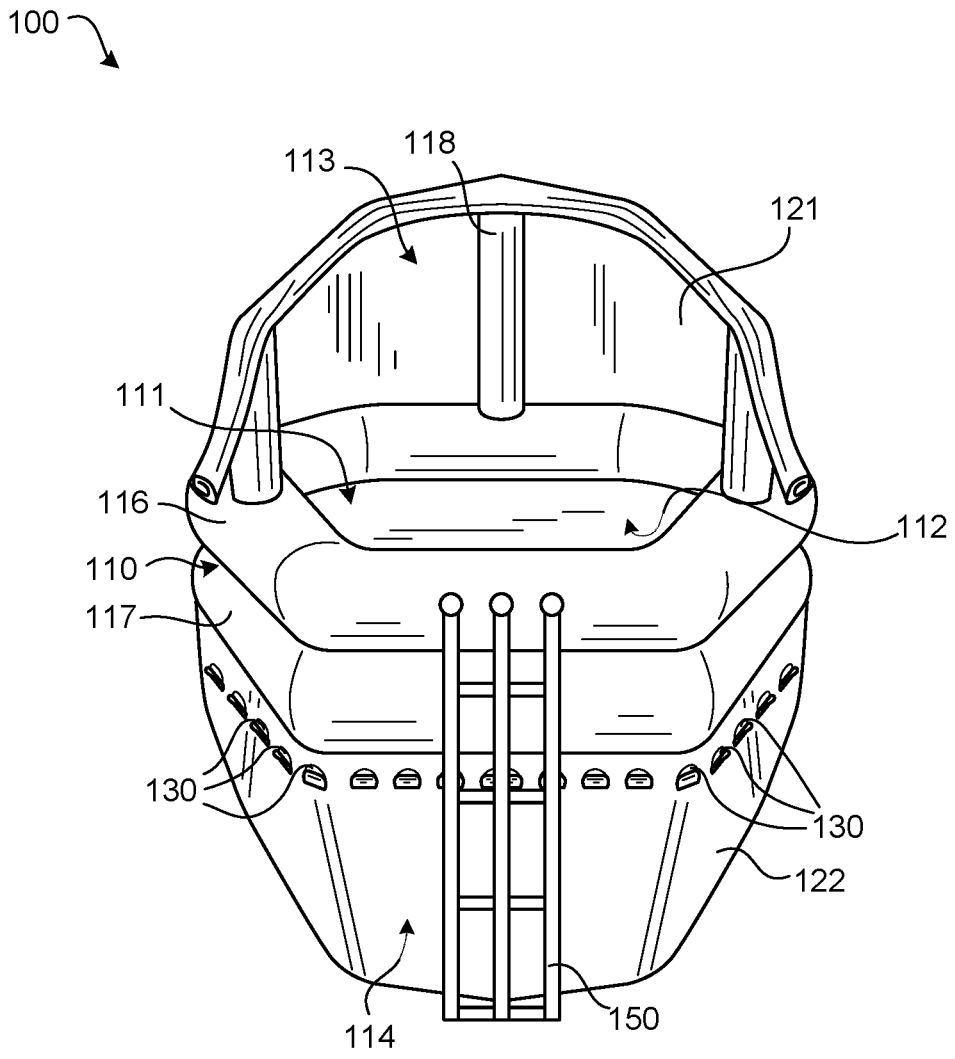
FIG. 1 is a perspective view of a life raft with a first canopy at least partially open to allow passengers to embark and a second canopy define a plurality of fill ports, in accordance with various embodiments.

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosures, it should be understood that other embodiments may be realized and that logical changes and adaptations in design and construction may be made in accordance with this disclosure and the teachings herein. Thus, the detailed description herein is presented for purposes of illustration only and not of limitation. Throughout the present disclosure, like reference numbers denote like elements. Accordingly, elements with like element numbering may be shown in the figures but may not be necessarily be repeated herein for the sake of clarity.

In the event of an emergency water landing, aircraft typically have one or more life rafts that can be deployed to hold evacuated passengers. To protect passengers from the sun, rain, weather conditions, and other elements, life rafts include a canopy for shielding the passengers from the aforementioned conditions. Disclosed herein, according to various embodiments, is a life raft that includes a dual canopy assembly configured to provide protection to passengers and to stabilize the life raft by reducing the likelihood of capsizing. Said differently, the life raft provided herein is deployed without conventional ballast bags, thus decreasing the complexity of the life raft, decreasing the weight of the life raft, and decreasing the cost of the life raft, according to various embodiments.

In various embodiments, and with reference to FIG. 1, life raft 100 is provided. The life raft 100 generally includes a base 110, a first canopy 121, and a second canopy 122, according to various embodiments. The base 110 has a first side 111 and a second side 112 opposite the first side 111. The first canopy 121 is coupled to the first side 111 of the base 110 and is configured to extend across the first side 111 of the base 110 to form a first chamber 113 defined between the first side 111 of the base 110 and the first canopy 121, according to various embodiments. A similar arrangement may exist on the opposite side of the life raft 100. That is, the second canopy 122 may be coupled to the second side 112 of the base 110 and may be configured to extend across the second side 112 of the base 110 to form a second chamber 114 defined between the second side 112 of the base 110 and the second canopy 122. In various embodiments, at least one of the first canopy 121 and the second canopy 122 have/define a plurality of fill ports. For example, the second canopy 122 may define a plurality of fill ports 130. The canopies 121, 122 may be made from a fabric material, a plastic material, or a composite material, among others. For example, the canopies 121, 122 may be made from nylon or a nylon material coated with a thermoplastic material, among others.

The first side 111 of the base 110 of the life raft 100 may be a top surface of the life raft 100 upon which passengers are supported in response to the life raft 100 being deployed in water. That is, the base 110 of the life raft 100 may be inflatable and may thus be configured to float on water. The life raft 100 may include one or more ladders 150 that facilitate passenger embarking. The second side 112 of the base 110 of the life raft 100 may be a bottom surface of the life raft 100 that faces the water.

The first canopy 121, according to various embodiments, is a top canopy that is configured to extend above the first side 111 of the base 110 of the life raft 100 to function as a protective covering that shields passengers from sun, rain, weather conditions, and other elements. The second canopy 122, according to various embodiments, is a bottom canopy that is configured to extend below the life raft 100. Water may be configured to flow into the second chamber 114 via the plurality of fill ports 130 defined in the second canopy 122. Said differently, water may be allowed to passively enter the second chamber 114 via the plurality of fill ports 130, thereby providing a stabilizing ballast cavity that reduces the likelihood of the life raft capsizing. The water in the ballast cavity imparts weight to the life raft 100 and lowers the center of gravity of the life raft 100, thus inhibiting the life raft 100 from overturning. In various embodiments, the stabilizing ballast cavity is the exclusive ballast component of the life raft 100. In other words, the life raft 100 may be free of conventional ballast bags. Additional details pertaining to the fill ports 130 and the stabilizing ballast cavity are provided below.

In various embodiments, the dual canopies 121, 122 of the life raft 100 enable the life raft 100 to be reversibly deployed (i.e., the life raft 100 may be reversible). That is, the first canopy 121 and the corresponding first chamber 113 may function as a passenger protecting top covering or a stabilizing ballast cavity, depending on the orientation of the life raft 100 when inflated and deployed into the water. The same may be true of the second canopy 122 and the corresponding second chamber 114. That is, the second canopy 122 and the second chamber 114 may function as a passenger protecting top covering or a stabilizing ballast cavity, depending on the orientation of the life raft 100 when inflated and deployed into water. In such embodiments, both the first canopy 121 and the second canopy 122 may have a respective set of fill ports, as described in greater detail below with reference to FIG. 2.

Figure 2:
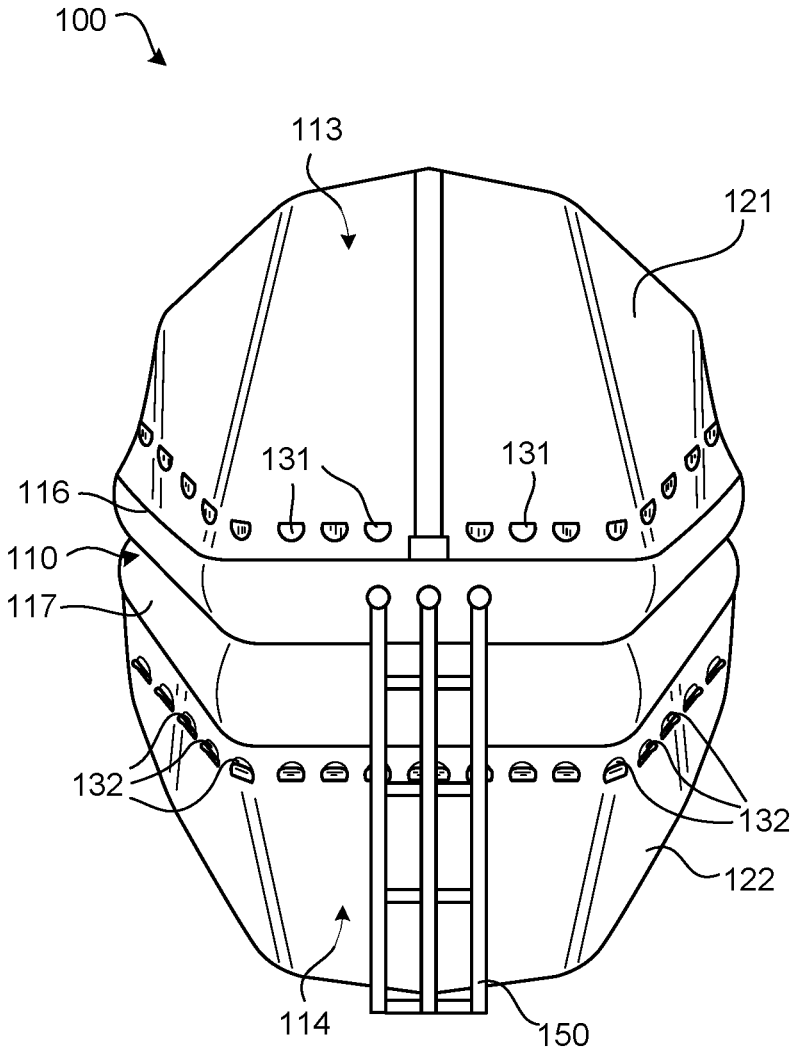
FIG. 2 is a perspective view of a life raft with a first canopy and a second canopy having a plurality of fill ports, in accordance with various embodiments.

In various embodiments, and with reference to FIG. 2, both canopies 121, 122 may have a respective plurality of fill ports. For example, the first canopy 121 may define a first plurality of fill ports 131 and the second canopy 122 may define a second plurality of fill ports 132. Accordingly, in response to the first chamber 113 being deployed above the base 110 and the second chamber 114 being deployed below the base 110, the first chamber 113 may function as a passenger compartment and the second chamber 114 may function as a stabilizing ballast cavity. Further, in response to the first chamber 113 being deployed below the base 110 and the second chamber 114 being deployed above the base 110, the first chamber 113 may function as the stabilizing ballast cavity and the second chamber 114 may function as the passenger compartment.

In various embodiments, the base 110 may include a first border tube 116 and a second border tube 117. The first and second border tubes 116, 117 may provide buoyancy to the life raft 100 and may be mounted one above the other. The first and second border tubes 116, 117 may provide a degree of buoyancy redundancy in that each border tube may be independent capable of supporting the weight of the life raft 100 when filled to capacity with passengers. The first border tube 116 may circumscribe the first side 111 of the base 110 and the second border tube 117 may circumscribe the second side 112 of the base 110.

In various embodiments, an arch structure 118 (FIG. 1) may extend from the base 110 (e.g., the first border tube 116 and the second border tube 117). In various embodiments, a first arch structure 118 may extend from the first side 111 of the base 110 (e.g., the first border tube 116) and a second arch structure may extend from the second side 112 of the base 110 (e.g., the second border tube 117) to provide structural support for the respective canopies 121, 122. That is, the first canopy 121 may be coupled to the first arch structure 118 and the second canopy 122 may be coupled to the second arch structure. In various embodiments, the arch structure(s) may simultaneously inflate/deploy with the base 110. In various embodiments, the life raft 100 may include an orientation sensing valve that controls which arch structure is inflated/deployed. The arch structure that is disposed on the bottom side of the life raft 100 may not need to be inflated, and the bottom chamber (e.g., 114) may be filled with water entering the fill ports 132 defined in the bottom canopy (e.g., 122).

In various embodiments, the fill ports 131, 132 may be arranged in a row and the individual fill ports may be circumferentially distributed around the respective canopies 121, 122. In various embodiments, the row of fill ports 131, 132 may extend adjacent and parallel to respective border tubes 116, 117.

Figure 3:
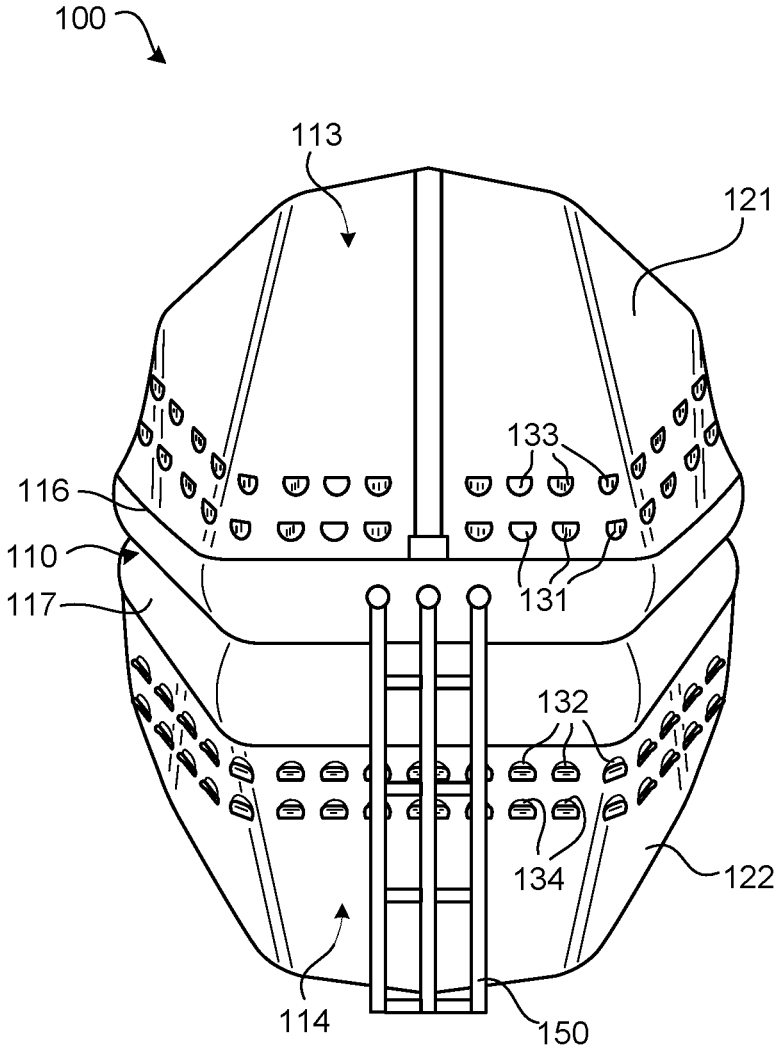
FIG. 3 is a perspective view of a life raft with a first canopy having multiple rows of fill ports and a second canopy having multiple rows of fill ports, in accordance with various embodiments.

In various embodiments, and with reference to FIG. 3, one or both of the canopies 121, 122 may define multiple rows of fill ports 131, 132, 133, 134. Said differently, in addition to a first row of fill ports 131 defined in the first canopy 121 and a second row of fill ports 132 defined in the second canopy 122, the first canopy 121 may also define a third row of fill ports 133 and the second canopy 122 may also define a fourth row of fill ports 134. The third and fourth rows of fill ports 133, 134 may be circumferentially distributed around the respective canopies 121, 122 and may extend parallel to the first and second rows of fill ports 131, 132.

In various embodiments, each fill port of the first plurality of fill ports and the second plurality of fill ports has a cross-sectional area between about 5 $in^2$ (32 $cm^2$) and about 35 $in^2$ (225 $cm^2$). In various embodiments, each fill port of the first plurality of fill ports and the second plurality of fill ports has a cross-sectional area between about 7 $in^2$ (45 $cm^2$) and about 28 $in^2$ (180 $cm^2$). In various embodiments, each fill port comprises a circular aperture having a diameter between about 3 inches (7.6 cm) and about 6 inches (15.2 cm).

Figure 4:
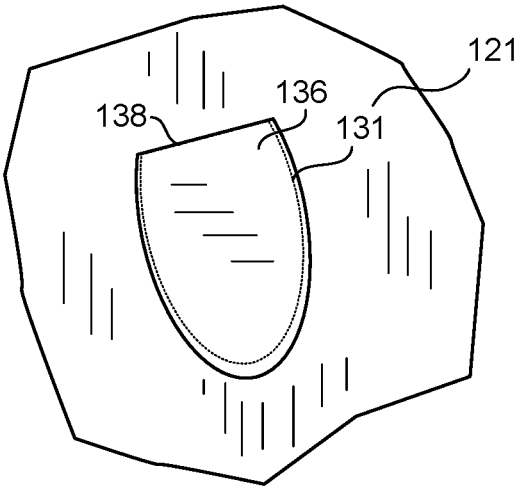
FIG. 4 is a perspective view of a flap covering a fill port, in accordance with various embodiments.
Figure 5:
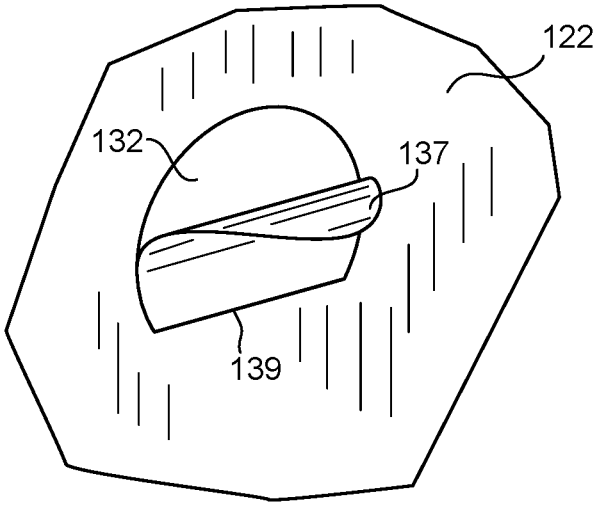
FIG. 5 is a perspective view a flap leaving a fill port uncovered/open, in accordance with various embodiments.

In various embodiments, and with reference to FIGS. 4 and 5, the fill ports 131, 132 may be configured to open and close in response to the orientation of the life raft. Said differently, the fill ports 131 defined in the first canopy 121 (e.g., top canopy) may be configured to be in a closed position while the fill ports 132 defined in the second canopy 122 (e.g., bottom canopy) may be configured to be in an open position. For example, each top fill port 131 may include a flap 136 that is coupled to the first canopy 121 along a top edge 138 of each fill port 131, thus allowing the flap 136 to hang down and cover the fill port 131 while each bottom fill port 132 may include a flap 137 that is coupled to the second canopy 122 along a bottom edge 139 of each fill port 132, thus allowing the flap 137 to bend away from the fill port 132, thus maintaining the fill port 132 open to allow water to enter the stabilizing ballast cavity.

Figure 6:
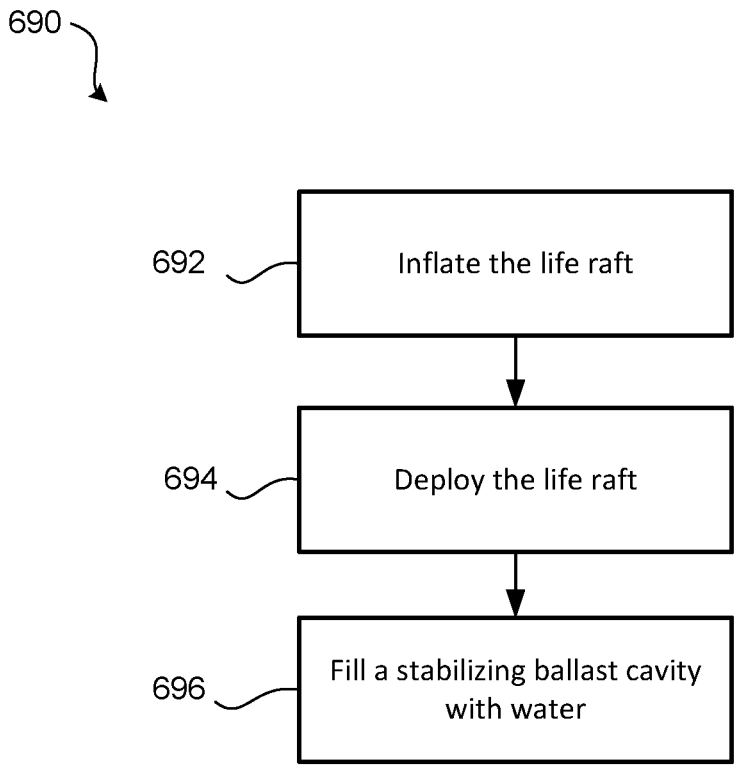
FIG. 6 is a schematic flow chart diagram of a method of using a life raft, in accordance with various embodiments.

In various embodiments, and with reference to FIG. 6, a method 690 of using the life raft 100 is provided. The method 690 may include inflating the life raft 100 at step 692, deploying the life raft 100 (e.g., onto water) at step 694, and filling the stabilizing ballast cavity with water at step 696. The first chamber 113 defined between the first canopy 121 and the first side 111 of the base 110 of the life raft 100 may be disposed above the water at step 694 to function as the passenger compartment and the second chamber 114 defined between the second canopy 122 and the second side 112 of the base 110 of the life raft 100 may be dispose below the water at step 694, thus allowing the second chamber 114 (e.g., the stabilizing ballast cavity) to fill with water via the fill ports 132 at step 696. The method 690 may further include at least partially opening the passenger compartment for passengers to embark. In various embodiments, in response to deployment of the life raft 100 in water at step 694, the plurality of fill ports in the stabilizing ballast cavity may be in an open position.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure.

The scope of the disclosure is accordingly to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. All ranges and ratio limits disclosed herein may be combined.

Moreover, where a phrase similar to "at least one of A, B, and C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

Any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts or areas but not necessarily to denote the same or different materials. In some cases, reference coordinates may be specific to each figure.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A life raft comprising:

a base comprising a first side and a second side;

a first canopy coupled to the first side of the base and configured to extend across the first side of the base to form a first chamber defined between the first side of the base and the first canopy;

a second canopy coupled to the second side of the base and configured to extend across the second side of the base to form a second chamber defined between the second side of the base and the second canopy;

wherein a first plurality of fill ports are defined in the first canopy and a second plurality of fill ports are defined in the second canopy, wherein the first plurality of fill ports extend through the first canopy and the second plurality of fill ports extend through the second canopy, wherein:

in response to the life raft being deployed with the first chamber disposed below the base, the first plurality of fill ports are open to the first chamber such that the first chamber functions as a stabilizing ballast cavity and the second plurality of fill ports are closed such that the second chamber functions as a passenger compartment;

in response to the life raft being deployed with the second chamber disposed below the base, the second plurality of fill ports are open to the second chamber such that the second chamber functions as the stabilizing ballast cavity and the first plurality of fill ports are closed such that the first chamber functions as a passenger compartment;

wherein each fill port of the first plurality of fill ports and the second plurality of fill ports has a cross-sectional area between about 7 $in^2$ (45 $cm^2$) and about 28 $in^2$ (180 $cm^2$); and in response to deployment of the life raft, fill ports of the passenger compartment are configured to close and fill ports of the stabilizing ballast are configured to open.

2. The life raft of claim 1, wherein the first plurality of fill ports are distributed circumferentially around the first canopy to form a first row of fill ports and the second plurality of fill ports are distributed circumferentially around the second canopy to form a second row of fill ports.

3. The life raft of claim 2, wherein the first canopy further defines a third row of fill ports that are distributed circumferentially around the first canopy and the second canopy further defines a fourth row of fill ports that are distributed circumferentially around the second canopy.

4. The life raft of claim 1, wherein each fill por of the first plurality of fill ports and the second plurality of fill ports comprises a circular aperture having a diameter between about 3 inches (7.6 cm) and about 6 inches (15.2 cm).

5. The life raft of claim 1, wherein the fill ports of the passenger compartment comprise flaps that, in response to deployment of the life raft, hang down to cover the fill ports of the passenger compartment and the fill ports of the stabilizing ballast cavity comprise flaps that, in response to deployment of the life raft, hang down away from the fill ports of the stabilizing ballast cavity.

6. The life raft of claim 1, wherein the base comprises a first border tube circumscribing the first side of the base and a second border tube circumscribing the second side of the base.

7. The life raft of claim 1, further comprising an arch structure extending from the base, wherein the first canopy and the second canopy are coupled to corresponding portions of the arch structure.

* * * * *